US006200248B1

(12) United States Patent
Vestola et al.

(10) Patent No.: US 6,200,248 B1
(45) Date of Patent: Mar. 13, 2001

(54) ROLL FOR A PAPER OR BOARD MACHINE

(75) Inventors: Juhani Vestola, Jyväskylä; Kari Niemi, Tikkakoski, both of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/057,654

(22) Filed: Apr. 9, 1998

(30) Foreign Application Priority Data

Apr. 11, 1997 (FI) ..... 971542
Apr. 11, 1997 (FI) ..... 971543

(51) Int. Cl.[7] ..... B23P 15/00; B25F 5/02

(52) U.S. Cl. ..... 492/54; 492/53; 492/58; 162/118; 162/287; 501/132

(58) Field of Search ..... 162/287; 492/53, 492/54, 58

(56) References Cited

U.S. PATENT DOCUMENTS

| | | | | |
|---|---|---|---|---|
| 4,704,776 | | 11/1987 | Watanabe et al. | 29/132 |
| 4,748,736 | | 6/1988 | Miihkinen | 29/527.2 |
| 4,951,392 | | 8/1990 | Miihkinen | 29/895.211 |
| 4,989,306 | | 2/1991 | Leino et al. | 29/132 |
| 5,070,587 | | 12/1991 | Nakahira et al. | 29/132 |
| 5,111,567 | | 5/1992 | Leino et al. | 29/132 |
| 5,223,099 | * | 6/1993 | Salo | 162/207 |
| 5,272,851 | | 12/1993 | Orloff et al. . | |
| 5,667,641 | * | 9/1997 | Poirer et al. | 162/207 |
| 5,967,959 | * | 10/1999 | Niemi et al. | 429/54 |

FOREIGN PATENT DOCUMENTS

| | | |
|---|---|---|
| 1314164 | 9/1993 | (CA) . |
| 0207921 | 4/1986 | (EP) . |
| 0369968 | 5/1990 | (EP) . |
| 0481321 | 4/1992 | (EP) . |
| 0597814 | 5/1994 | (EP) . |
| 0598737 | 6/1994 | (EP) . |
| 0657237 | 6/1995 | (EP) . |
| 84506 | 8/1991 | (FI) . |
| 87942 | 12/1991 | (FI) . |
| 924754 | 10/1992 | (FI) . |
| 9113204 | 9/1991 | (WO) . |
| 9323617 | 11/1993 | (WO) . |
| 9641918 | 12/1996 | (WO) . |
| 9715719 | 5/1997 | (WO) . |

OTHER PUBLICATIONS

Japanese Abstract of Patent No. 5179 596 A (1 page).

* cited by examiner

*Primary Examiner*—James Derrington
(74) *Attorney, Agent, or Firm*—Steinberg & Raskin, P.C.

(57) ABSTRACT

A roll for use in the manufacture of paper and board, a press roll, in particular a center roll in a press, a backup roll for an extended-nip press roll, a hot press roll, or equivalent, which is in direct contact with a wet paper web, or a calender roll, a method for manufacturing the same and a coating composition therefor including an adhesion layer arranged on the frame part of the roll and a ceramic layer arranged on the adhesion layer. The ceramic layer has a thickness of from about 100 $\mu$m to about 2000 $\mu$m and includes from about 50% to about 95% by weight of $Cr_2O_3$ and from about 3% to about 50% by weight of $TiO_2$, or from about 50% to about 80% by weight of $Al_2O_3$ and from about 20% to about 50% by weight of $ZrO_2$, or exclusively $Al_2TiO_5$. The outer face of the ceramic layer is finished until the roughness Ra is from about 0.2 $\mu$m to about 2.0 $\mu$m and/or the porosity of the outer face of the roll is from about 1% to about 20%. In addition to or instead of $TiO_2$, the ceramic layer may contain oxides of aluminum, silicon, zirconium, magnesium, manganese, tin, tungsten and mixtures thereof.

9 Claims, 4 Drawing Sheets

RUBBER WHEEL ABRASION TEST
WEAR DISTANCE 5904 m.
ABRASIVE: QUARTZ SAND
0.1-0.6 mm

ROLL FOR A PAPER OR BOARD MACHINE

FIELD OF THE INVENTION

The present invention relates to a roll for use in the manufacture of paper and board, in particular a press roll, a center roll in a press, a backup roll for an extended-nip press roll, a hot press roll, or an equivalent press roll which is in direct contact with a wet paper web, or a calender roll.

The present invention also relates to a method for manufacturing a roll for a paper or board machine or calender.

The present invention further relates to a coating composition for a roll for a paper or board machine or calender.

BACKGROUND OF THE INVENTION

Press rolls and calender rolls are critical components in a paper machine both from the point of view of the runnability of the machine and from the point of view of the quality of the product, because in a press and in a calender, the roll face is often in direct contact with the paper web. Direct contact with the face of a roll has a significant effect on the surface properties of paper, which imposes high requirements on the quality of the face of the roll. The surface properties of the roll are also critical from the point of view of the papermaking process. The wet or coated paper web must adhere to the roll in a suitable way, however, on the other hand, it must also be readily separable from the roll. It must be readily possible to doctor the roll, easy to keep it clean, and the roll must remain in good operating condition for a long period of time. Further, from the point of view of runnability, it is essential that the surface properties of the roll do not change during the process so that, for example, the separability of the web from the roll face cannot be suitably controlled. Owing to the direct contact of the roll face with the web, fibers and contaminations adhere to the roll face and block the surface layer and, consequently, the surface properties of the roll are changed. In order to amend the effect of contamination, the roll is doctored, which again imposes its requirements on the mechanical surface properties of the roll, i.e., the roll face must adequately withstand the effects of doctoring.

In a press, particularly demanding surface properties are required from center rolls in presses. At center rolls, the web is pressed against the roll face in two or more nips. Also, demanding surface properties are required from backup rolls of extended-nip presses in which the contact face between the web and the roll is longer and the nip load higher. In these cases, the tendency of sticking of the web and contamination of the roll in web contact are particularly intensive. In such positions, in particular in wide paper machines, variable-crown rolls are used. The roll face is further subjected to particularly demanding conditions when the pressing takes place at an elevated temperature either by heating the web before the center roll (e.g., by means of a steam box) or by means of the roll when the web is on the roll face (heatable center roll or so-called impulse drying).

The granite roll, which has been traditionally used in the press section of a paper machine, has been abandoned in recent years in spite of the excellent surface properties of granite. The reason has been mainly the requirements of strength and durability increased along with higher running speeds as well as the need to profile and to heat the roll. Synthetic rock rolls, which have been coated with a mixture of ceramic powder added to a hard rubber and polyurethane or some other polymer, have performed poorly because of their low mechanical strength and excessive adhesion of the paper web to the roll face.

By means of calender rolls, the surface of paper or board can be given the desired gloss, smoothness, and finished face. Traditionally, calendering has been used mainly for compacting the surface of paper, which has taken place by means of rolls which are as smooth as possible. For this purpose, chilled rolls and hard-chromium plated rolls have been commonly used. Electrolytic hard-chromium plating has been highly laborious as a process for rolls of large size, and with respect to the quality of the face to be chromium-plated, it has been highly demanding. From the point of view of the plating process, the high susceptibility of wear of the hard-chromium plated face has constituted a problem, which wear has been increased further by the micro-particles contained in the coating material, such as clay. Owing to the wear of the plated face, the capability of holding/adhesion of the face is deteriorated, and doctoring becomes more difficult and causes streaks in the web. The production of dull-finish grades by means of the prior art rolls has not been suitable because of the rapid smoothing of the face.

Owing to the circumstances mentioned above, alternative solutions for coatings of rolls have been developed both for press rolls and for calender rolls. Most commonly, at present, rolls with metal frames are used which have been coated with a metal, a ceramic, ceramic-metal, polymers or elastomers and various mixtures of the same.

Ceramic and ceramic-metal coatings and coating processes have been described, for example, in the following publications.

In Finnish Patent Application No. 853544, a roll coating is described which consists of a metal or a mixture of a metal and a ceramic material.

In Finnish Patent No. 70,273, mixtures of metal powder and inorganic material are suggested as a coating for a press roll.

On the other hand, in Finnish Patent Application No. 861803, a construction of a press roll is described, in which a metallic adhesion layer has been applied onto the face of a metal frame, which adhesion layer has a thermal expansion coefficient lower than that of the metal frame, and onto the adhesion layer, a ceramic surface layer has been applied.

In Finnish Patent No. 84,506, a press roll is described whose metallic frame cylinder is coated with an intermediate layer consisting of a composite compound made of a ceramic material and a metal, and then with a ceramic surface layer. The mixing ratio of the components in the composite compound is different in different parts of the intermediate layer in the direction of the radius of the roll.

In Finnish Patent No. 86,566, a center roll for a press is described, which has been manufactured so that the mantle of the roll frame has been coated with a corrosion-protection layer which consists of chromium-containing stainless steel as well as of a surface layer which has been prepared by thermal spraying of a powder in which the metal and ceramic phases are contained in the same powder particle.

In International Patent Application WO 93/01326, a composition of a coating for a press roll is described, which comprises a mixture of aluminum silicate and alkaline-earth metal oxide that has been plasma-sprayed onto the face of the roll.

In European Patent Application 0 657 237, thermal spraying of cobalt-containing tungsten carbide granules and nickel-containing chromium carbide granules onto the roll face is described.

In Finnish Patent No. 89,950, a press roll for a paper machine is described, in which the mantle of the metal core of the roll has been coated with a metal layer that contains molybdenum-based and nickel-based metal alloys. Onto the metal layer, a ceramic coating is prepared by means of thermal spraying. Suitable ceramic compounds are grey aluminum oxide (95% $Al_2O_3$—2.5% $TiO_2$), white aluminum oxide (99% $Al_2O_3$), titanium dioxide ($TiO_2$), etc. and mixtures of same.

In European Patent Application 0 481 321, a press roll is described in which an intermediate layer made of a molybdenum-based or nickel-based alloy has been applied onto the metal core, for example, by plasma spraying, and onto this layer a ceramic layer has been applied by plasma spraying, which layer consists of metal oxides or of mixtures of same. Finally, the roll is coated with an organic polymer to fill the pores in the ceramic coating.

International Patent Application WO 96/41918 is an example of a hot press roll having a coating prepared by means of thermal spraying of a metal-ceramic and a mixture of a ceramic and a certain metal alloy.

In Finnish Patent No. 92,609, a method is described in which a metal-ceramic face is sprayed onto the face of a hot-glaze calender roll or a calender roll for a machine stack, which rolls are supposed to increase the gloss of paper. The metal-ceramic mixture consists of tungsten carbide and cobalt or a nickel-chromium alloy. After coating, the face is finished by grinding.

In Finnish Patent No. 80,097, a method is described in which the roll is coated with a mixture which consists partly of a metal and partly of a ceramic material, so that the outer surface is composed of carbide-rich areas and matrix areas placed between the carbide-rich areas. Chemically, the coating on the roll is an alloy of tungsten, chromium and carbon, or an alloy of tungsten carbide, tungsten, cobalt, chromium, and carbon.

A heatable calender roll with a ceramic coating is described in European Patent No. 0 598 737, wherein a face as smooth as possible is aimed at, and a press roll with a ceramic or cermet face is described in European Patent No. 0 597 814.

It has, however, been noticed that the prior art ceramic-coated rolls mentioned above and currently available on the market involve a number of problems, deficiencies or limitations, which have become ever more critical when the running speed of the paper machine becomes higher and when the basis weight of the paper becomes lower. The process of detaching of the web and the doctoring quality are more difficult to control. These drawbacks are particularly problematic in the case of center rolls in presses and backup rolls in extended-nip presses. The Cr-oxide and Al-oxide based coatings currently in use involve drawbacks with respect to their mechanical and chemical strength. Chromium oxides are hard, but their toughness is poor, and mechanical damage tends to arise. In mechanically highly abrading conditions, the roll face is worn and ground smooth, in particular in the case of $Al_2O_3$-based ceramics, and $Al_2O_3$-based ceramic coatings do not endure doctoring with a steel blade. The resistance of ceramic coatings to chemical strains is deficient, which results in damage to the surface layer of the roll, such as corrosion and delamination. In particular, $Al_2O_3$-based ceramic coatings do not endure washing with lye.

Ceramic coatings have often been thermally sprayed onto the roll face, which unavoidably results in porosity of the face. Owing to the porosity, agents that produce corrosion have access to the boundary face between the roll and the adhesion coating unless the tightness of the adhesion and corrosion-protection layer is adequate. Flaws in the adhesion layer placed under the ceramic layer may result in corrosion in the roll under the coating and thus, in destruction of the whole roll during a long period of time. Difficulties are further caused by the material gathering in the face of the roll, which tends to block the pores in the surface layer, in which connection the properties of adhesion of the roll are changed.

The face of a roll must endure high linear loads, which strain the coating. Besides hardness, toughness and resistance to wear are also required from a coating. Also, the coating must be easy to repair, it must tolerate variations of temperature very well, and it must operate in a wide range of temperatures in a range of from about 10° C. to about 250° C. and under a nip pressure of from about 5 MPa to about 50 MPa. The face of the roll must be sufficiently hard to endure the abrading effect of the filler agents in the paper, the abrading effect of a doctor, and the effect of a corroding environment. Moreover, a roll must have the necessary surface properties for keeping the roll clean, for adhesion and separation of the paper web, such as, among other things, suitable hydrophily. Also, the coating must retain its original roughness, i.e., the Ra value, as long as possible. The face of a roll must be capable of producing the desired properties, such as, for example, uniformity of quality, low gloss (so-called dull finish), and good smoothness, or good gloss (not dull) for the paper, in particular in calender applications.

OBJECTS AND SUMMARY OF THE INVENTION

Accordingly, it is an object of the present invention to provide a durable ceramic roll.

It is another object of the present invention to provide new and improved methods for manufacturing a press roll and a calender roll which have a durable ceramic coating.

It is still another object of the present invention to provide new and improved ceramic coating compositions for press rolls and calender rolls which is durable.

Another object of the present invention to provide a coated press roll and a coated calender roll which overcome the drawbacks of the prior art coated rolls.

It is another object of the present invention to provide new and improved methods for manufacturing a coated press roll and a coated calender roll which overcome the drawbacks of the rolls produced by the prior art roll-coating methods.

It is still another object of the present invention to provide new and improved ceramic coating compositions for press rolls and calender rolls which avoid the drawbacks of the prior art coating compositions.

In view of achieving the objects of the invention set forth above, and others, the roll of a paper or board machine or finishing machine in accordance with the invention is coated with a coating which gives the face of the roll hardness, toughness and hydrophily and with which coating the roughness that has been given to the face is retained in the desired Ra range substantially unchanged for a long period of time. By means of a correctly chosen coating, attempts have been made to regulate the interaction between the solid matter, i.e., the roll face, and the liquid and the wet/coated paper face into an optimal range. Compositions of coating that meet these requirements include a mixture of chromium oxide and titanium dioxide, in which other metal oxides are possibly also included, a mixture of aluminum oxide and zirconium oxide, as well as aluminum titanate.

The preferred coating comprises chromium oxide and titanium dioxide. The proportions of the components are in the range from about 50% by weight to about 95% by weight of $Cr_2O_3$ and from about 3% to about 50% by weight of $TiO_2$. A more advantageous composition comprises from about 55% to about 80% of $Cr_2O_3$ and from about 20% to about 45% of $TiO_2$. The composition may possibly also include other metal oxide components, e.g., one or more oxides of aluminum, silicon, zirconium, magnesium, manganese, tin, tungsten and mixtures thereof.

With a chromium oxide content of 50%–95%, the coating can be given the necessary hardness and resistance to wear. The toughness of pure chromium oxide is poor, for which reason the content of chromium oxide cannot exceed 95%. With an addition of 3%–50% of titanium oxide, the surface can be given toughness so as to endure impact-like strains, which also improves the resistance to wear in an impact-like situation of wear. Delamination of the coating is also prevented. Further, titanium oxide mixed with chromium oxide increases the hydrophily of the surface, which improves the separation of the web decisively and also clearly reduces the tendency of contamination. An increase of the content of titanium oxide beyond about 50%, however, reduces the values of hardness and lowers the resistance to wear. The titanium oxide can also be partly or fully substituted for by oxides of aluminum, silicon, zirconium, magnesium, manganese, and tungsten, or by mixtures of same.

A tight and strong ceramic layer in accordance with the invention also improves the effect of protection from corrosion provided by a possible adhesion coating on the roll. The resistance to corrosion of chromium oxide is excellent, so that, for example, alkaline or acid chemicals used for washing of the roll do not cause corroding of the roll face. Mixing of titanium oxide does not reduce the wider pH-range that has been achieved, in which range it is possible to operate in the way indicated by Table 1.

TABLE 1

Solubility of coatings (ppm) in acid (pH 1) and alkaline (pH 13) conditions. Test period-1 week.

| COATING | pH 1 | pH 13 |
|---|---|---|
| $Al_2O_3$ (97%) | 4.9 | 4.6 |
| $Cr_2O_3$ (75%) and $TiO_2$ (25%) | 0.1 | 0.6 |
| $Cr_2O_3$ (92%) | 0.1 | 0.6 |

The porosity of a thermally sprayed ceramic coating in particular for press rolls is typically in a range from about 1% to about 20%. Penetration of contaminations into the coating is reduced when the porosity becomes lower. Thus, the effect of titanium oxide of tightening the $Cr_2O_3$ coating also promotes keeping the face clean, besides favorable toughness and surface properties.

Mixtures of aluminum oxide and zirconium oxide have also proved to be suitable coating compositions. True enough, aluminum oxide has its limitations in respect of the pH-range. However, owing to zirconium oxide, the mechanical durability is improved as reflected by an increased toughness of the mixture. An advantageous composition comprises from about 50% to about 80% $Al_2O_3$ and from about 20% to about 50% $ZrO_2$. A more advantageous composition comprises from about 55% to about 65% $Al_2O_3$ and from about 35% to about 45% $ZrO_2$. Another ceramic coating in accordance with the invention prepared by means of the high-velocity flame spraying technique (HVOF) or plasma flame spraying technique method preferably comprises $Al_2TiO_5$, possibly exclusively only $Al_2TiO_5$. The HVOF and plasma flame spraying technique may be used to spray any of the coatings described herein.

The roughness value Ra of a ceramic surface in accordance with the invention is in the range from about 0.2 $\mu$m to about 2.0 $\mu$em, preferably Ra is from about 0.4 $\mu$m to about 1.5 $\mu$m. Based on practical experiments, it has been noticed that an increase in the roughness up to a certain limit facilitates detachment of the web but, on the other hand, an excessively high roughness deteriorates the hold of the doctor and increases the wear of the blade. For the face of a calender roll, a surface profile suitable for dull-finish operation can be finished by brushing with silicon carbide. This roll endures doctoring considerably better than hard-chromium plated rolls do. In spite of variations in temperature, the face neither is delaminated nor cracks. In the following table, properties of a roll with ceramic coating in accordance with the invention are compared with prior art rolls.

TABLE 2

Properties of Calender Roll Coatings

| | Chilled | Carbide | Chromium-Plated | Ceramic |
|---|---|---|---|---|
| Hardness (HV) | 600 | 1100 | 900 | 1100 |
| Thickness (mm) | 10 | 0.1 | 0.1 | 0.3 |
| Roughness (Ra) | 0.1 | 0.2 | 0.1 | 0.4 |

This method for manufacture of the roll is suitable both for manufacture of new rolls and for coating of used rolls, provided that the old coating has been removed first.

The method for manufacturing a roll for a paper or board machine or a finishing machine in accordance with the invention comprises forming a ceramic layer a thickness of from about 100 $\mu$m to about 2000 $\mu$m on a frame part of the roll. The ceramic layer includes from about 50% to about 95% by weight of $Cr_2O_3$ and from about 3% to about 50% by weight of $TiO_2$, or from about 50% to about 80% by weight of $Al_2O_3$ and from about 20% to about 50% by weight of $ZrO_2$, or 100% $Al_2TiO_5$, or from about 50% to about 95% by weight of $Cr_2O_3$ and from about 2% to about 50% by weight of at least one metal oxide selected from a group consisting of oxides of aluminum, silicon, zirconium, magnesium, manganese, tin, tungsten and mixtures thereof. The outer face of any of the ceramic layers described above may be finished until the roughness Ra thereof is from about 0.2 $\mu$m to about 2.0 $\mu$m. At least one metal oxide selected from a group consisting of oxides of aluminum, silicon, zirconium, magnesium, manganese, tin, tungsten and mixtures thereof may be incorporated into the $Al_2O_3$ and $ZrO_2$ ceramic coating layer, the $Cr_2O_3$ and $TiO_2$ ceramic coating layer and the $Al_2TiO_5$ ceramic coating layer. At least one adhesion/corrosion-protection layer having a thickness of from about 50 $\mu$m to about 400 $\mu$m may be formed directly on the frame part by thermal spraying so that the ceramic layer is arranged on the outermost adhesion/corrosion-protection layer. In some embodiments, the ceramic layer is ground until an outer surface thereof has the desired roughness and the ground outer surface is finished to make a profile of the surface suitable for dull-finish operation.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
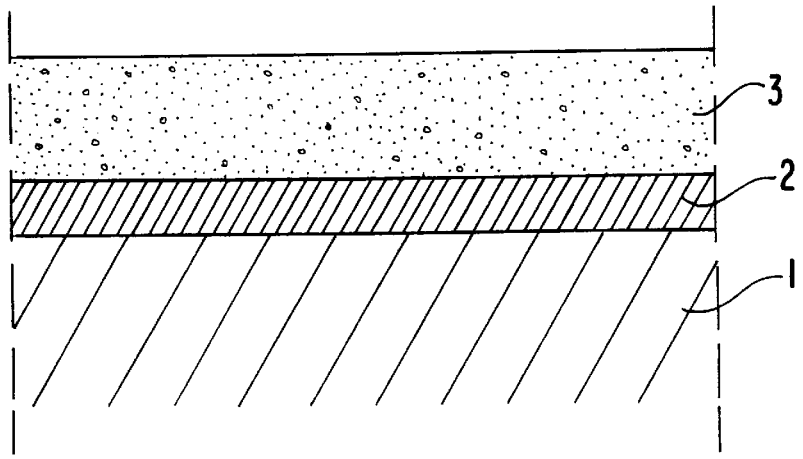
FIG. 1 is a view of a coated roll in accordance with the invention, coated by a method in accordance with the invention and including a coating composition in accordance with the invention.

Referring to the accompanying drawings wherein like reference numerals refer to the same or similar elements, FIG. 1 illustrates a preferred construction in accordance with the invention in the form of a cross-section of the face of a roll having a frame part 1, which may be the roll mantle. The roll in accordance with the invention includes a nickel-chromium adhesion face/corrosion-protection layer 2 applied onto the frame part 1, and a ceramic coating 3 having a thickness from about 100 $\mu$m to about 2000 $\mu$m arranged on the adhesion face/corrosion-protection layer 2. For calender applications, the thickness of the ceramic coating 3 is from about 300 $\mu$m to about 500 $\mu$m. The thickness of the layer 2 is from about 50 $\mu$m to about 400 $\mu$m, in a press application preferably from about 100 $\mu$m to about 400 $\mu$m, in a calender roll preferably from about 50 $\mu$m to about 200 $\mu$m.

Figure 2:
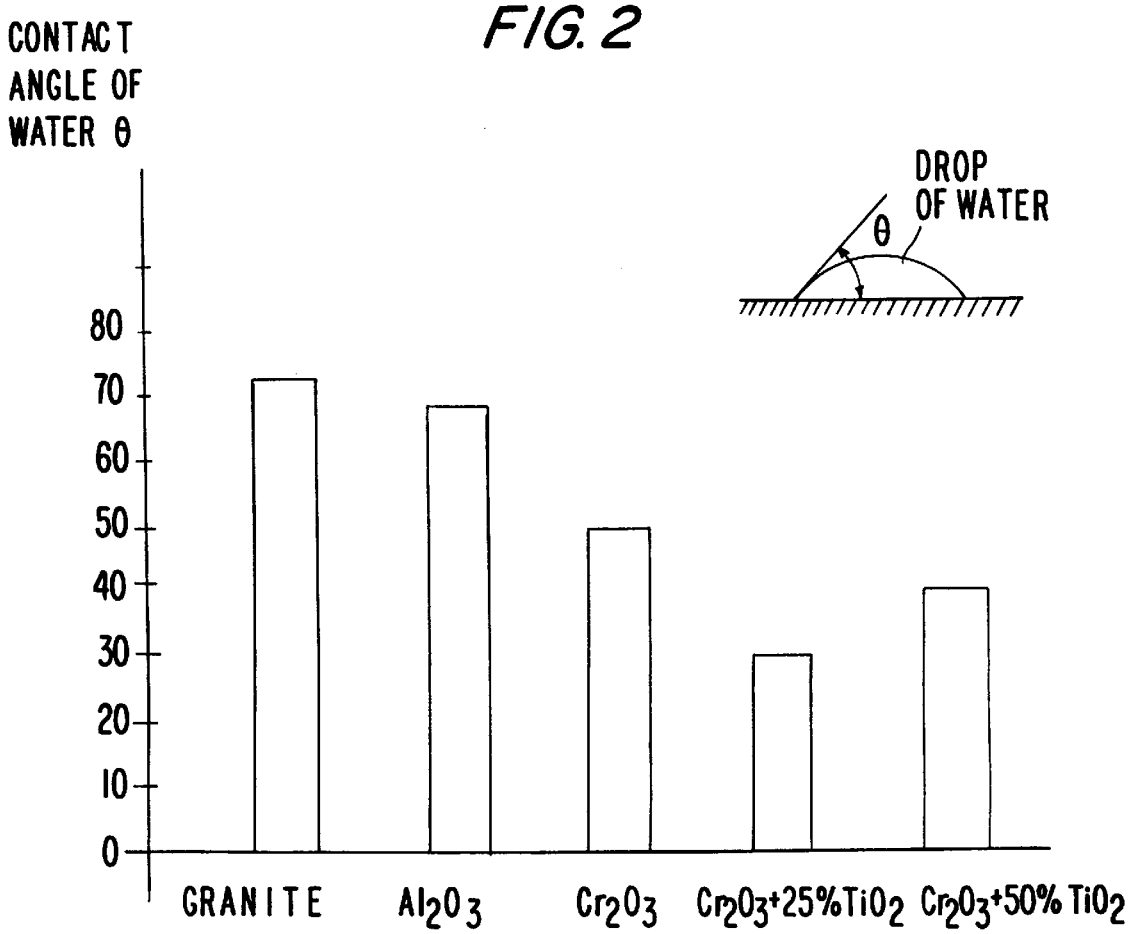
FIG. 2 is a chart of the hydrophily of the roll surface for rolls in accordance with the invention and prior art rolls.

FIG. 2 illustrates the hydrophily, i.e., the property of attracting water, of the roll face by means of the contact angle of water. In FIG. 2, roll faces consisting of granite, $Al_2O_3$, $Cr_2O_3$, $Cr_2O_3$ 75% and $TiO_2$ 25%, and $Cr_2O_3$ 50%+$TiO_2$ 50% are compared. The smaller the contact angle, the higher the hydrophily. From FIG. 2, it can be noticed that a face that contains 75% $Cr_2O_3$+25% $TiO_2$ is clearly the most hydrophilic face of all. The water film formed on the hydrophilic face prevents sticky agents from adhering to the roll face. At the same time, a sufficient film of water facilitates detaching of the web.

Figure 3:
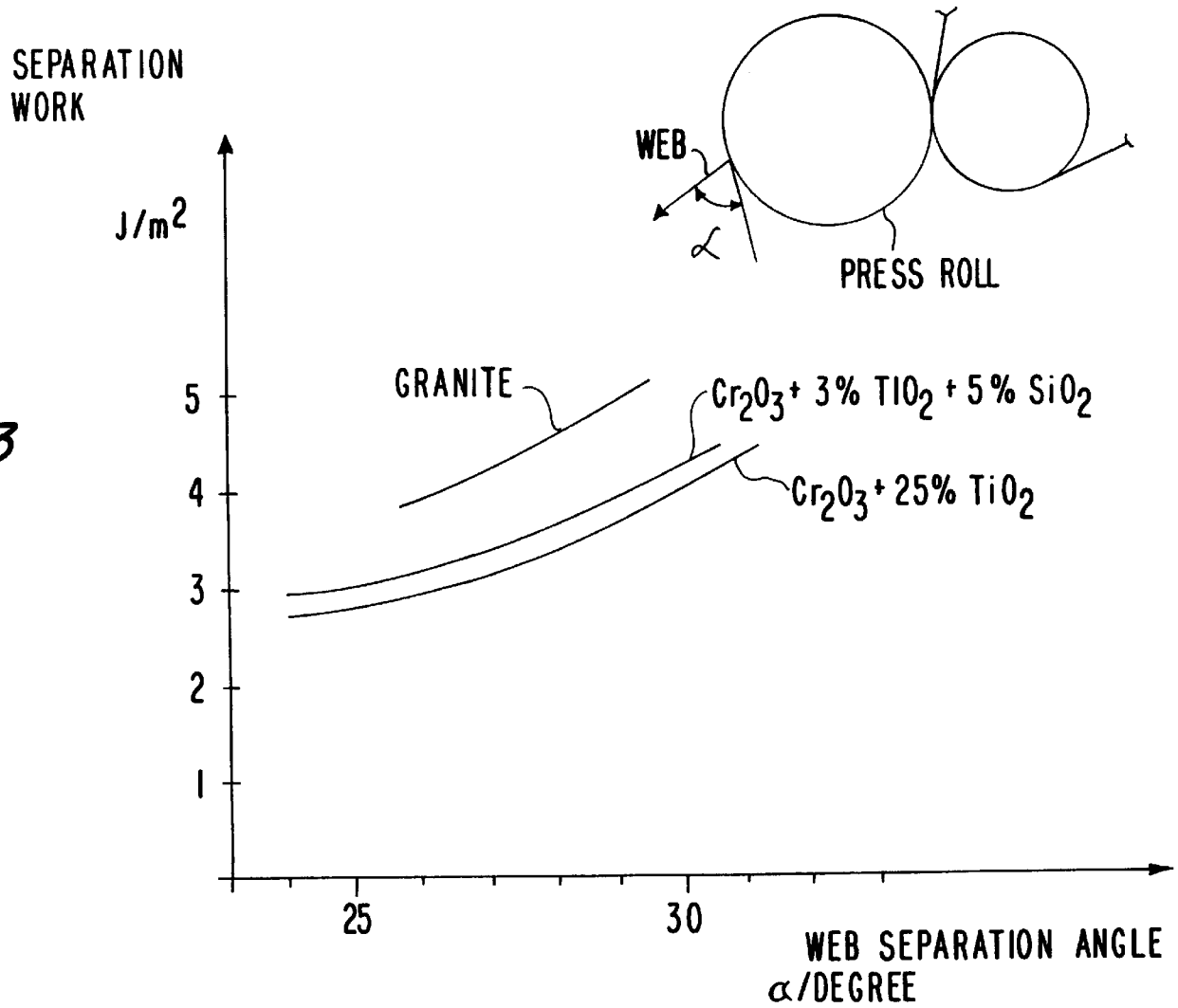
FIG. 3 is a chart of the separation of the paper web from the roll face for rolls in accordance with the invention and prior art rolls.

FIG. 3 illustrates the web separation work as a function of the web separation angle. The ease of separation of the web is illustrated best by the separation work ($J/m^2$). Under comparable conditions, the values of separation work illustrated in FIG. 3 are given as a function of the separation angle while a granite roll is compared with a press roll with a $Cr_2O_3$ 75%+25% $TiO_2$ coating and with a press roll whose coating contained $Cr_2O_3$ 92%, 3% $TiO_2$ and 5% $SiO_2$. The best values were obtained with a roll whose coating consisted of $Cr_2O_3$ 75%+25% $TiO_2$.

Figure 4:
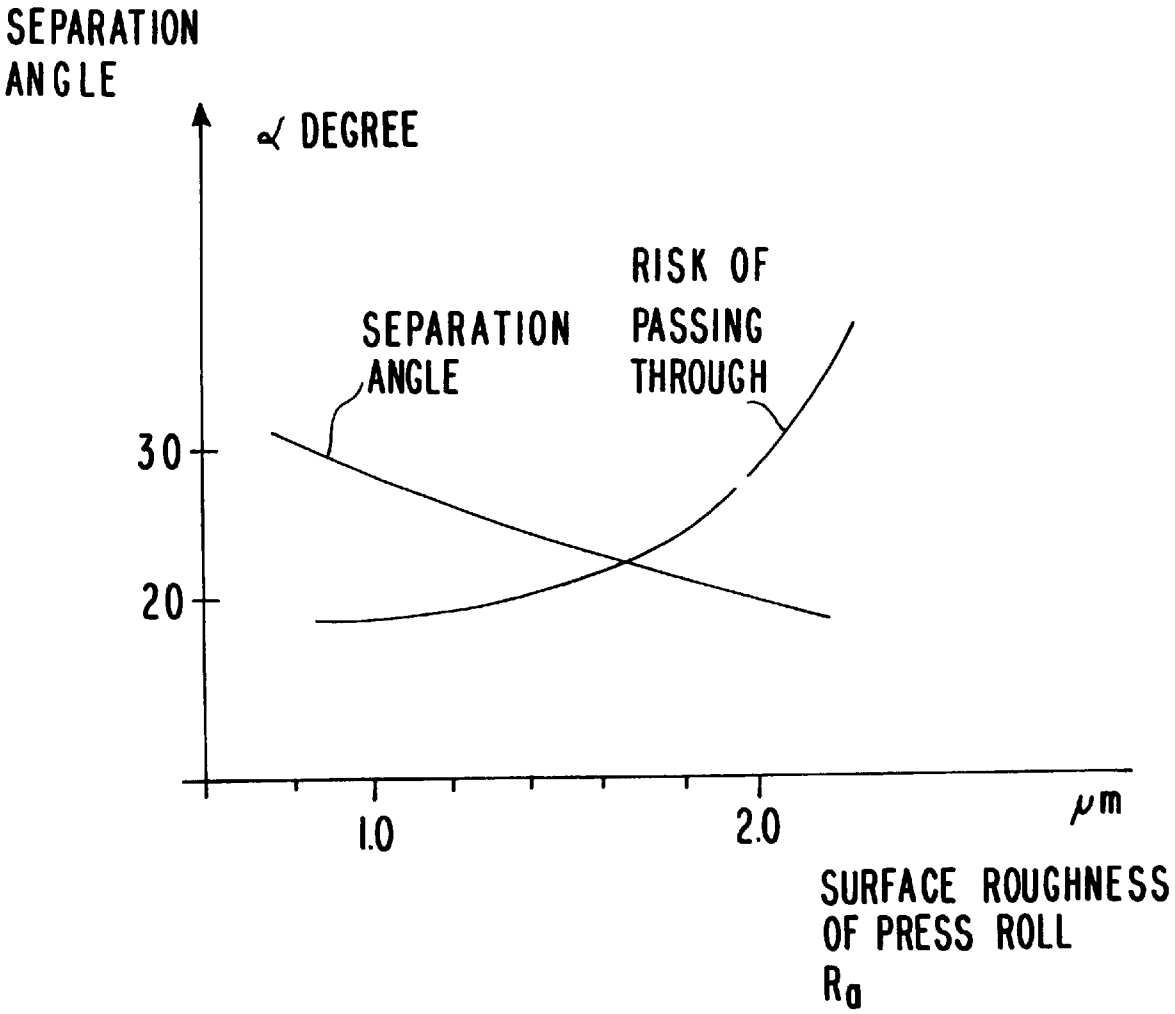
FIG. 4 is a chart of the effect of roughness of the roll on separation of the web for rolls in accordance with the invention and prior art rolls.

FIG. 4 illustrates the angle of separation as a function of the roughness of the surface of the press roll. The separation of the web can be measured by means of the angle of separation when all the other factors, for example the properties of the web etc., are kept invariable. A small angle of separation correlates with easy separation. In tests, under comparable conditions, the interdependence illustrated in FIG. 4 was obtained, on whose basis the roughness of the surface of the press roll must be kept in a certain range in order to minimize the risk of passing through of the web and, on the other hand, to maximize the ease of separation.

Figure 5:
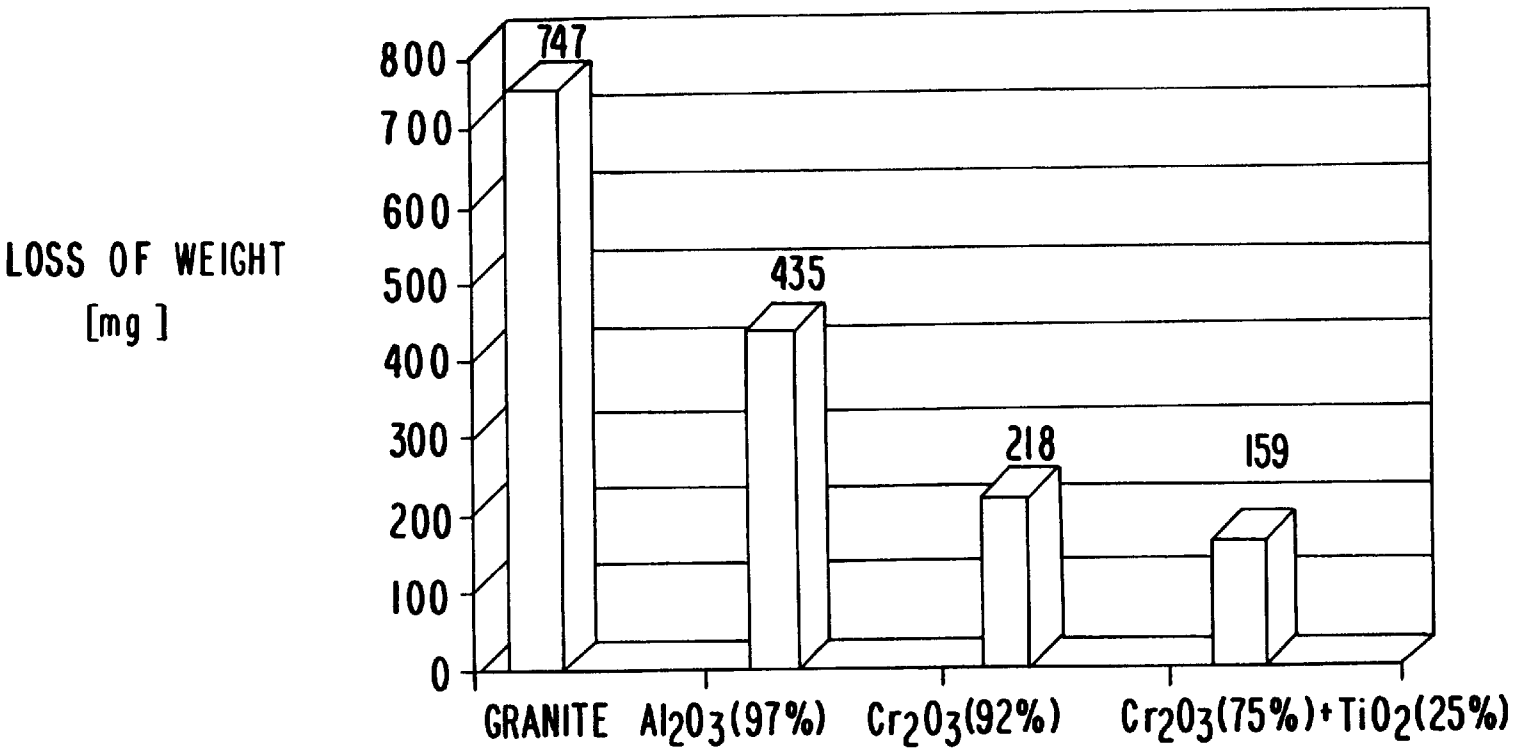
FIG. 5 is a chart of the resistance to wear of roll coatings for rolls in accordance with the invention and prior art rolls.

FIG. 5 illustrates the resistance to wear of different coatings in a rubber wheel abrasion test. The losses of weight of granite, an $Al_2O_3$ 97% coating, a $Cr_2O_3$ 92% coating, and of a $Cr_2O_3$ 75%+$TiO_2$ 25% coating were measured after quartz sand abrasion. Mixing of titanium oxide (25%) improves the abrasive wear resistance, because the toughness of the coating is better than with a purer (92%) chromium oxide. On the other hand, the hardness of the coating higher than that of granite provides a better resistance to wear. It can be ascertained that the loss of weight of the $Cr_2O_3$ 75%+$TiO_2$ 25% coating was lowest, i.e., its resistance to wear was best.

The method in accordance with the invention for coating of rolls as well as the coating in accordance with the invention are suitable for coating of a roll used in the manufacture of paper and board, in particular a center roll in a press, a backup roll for an extended-nip press roll, a hot press roll or equivalent (which rolls are generally variable-crown rolls), a calender roll (in particular a thermo roll for a calender), or a roll used for impulse drying.

The following examples illustrate the invention in more detail.

The mantle of the roll frame, which can be made of iron, steel, or equivalent, is coated with an adhesion face, which is made of a metal or an alloy of metals, preferably nickel-chromium alloy, and whose thickness is from about 100 $\mu$m to about 400 $\mu$m, by means of a thermal spraying method. A ceramic surface layer containing from about 50% to about 95% $Cr_2O_3$ and from about 5% to about 50% $TiO_2$ is applied onto the adhesion face by means of a high-velocity flame spraying method (HVOF) or a plasma spraying method (APS). These application methods produce the necessary melting of the particles and results in a tight and strong face. The coating has very high hardness, toughness and resistance to corrosion. In the face, no effect of delamination occurs at all, and the wear and the smoothing of the face as a result of mechanical strain are very little. For this reason, in connection with the coating, it is possible to use a steel doctor, which does not scratch the face. A wet paper web adheres to the roll in accordance with the invention appropriately, but is separated from the roll readily so that the separation angle is in an optimal range even at high running speeds. The roll can be doctored readily and is easy to keep clean. Also, the roll face is appropriately hydrophilic and resistant to contamination and provides the paper web with optimal properties of adhesion and separation. Further, the porosity and the roughness of the roll face are in a range in which the properties of separation and adhesion of the paper web are optimal and in which, on the other hand, the properties of doctoring of the roll remain good.

A coating in particular suitable for dull-finish calendering is achieved when a roll which is provided with a conventional roll frame part 1, such as, for example, a chilled roll frame, and which has a hard face is coated with an adhesion/corrosion-protection layer 2 having a thickness from about 50 $\mu$m to about 200 $\mu$m, preferably from about 100 $\mu$m to about 150 $\mu$m, which layer 2 consists of an alloy of nickel and chromium. A ceramic coating layer having a thickness from about 300 $\mu$m to about 500 $\mu$m, preferably from about 350 $\mu$m to about 400 $\mu$m, is applied onto the adhesion layer 2 by means of plasma spraying or high-velocity flame spraying (HVOF). By means of the choice of the coating, the wear resistance and the toughness of the roll face can be affected to a substantial extent. The face is roughened to the desired roughness, and the surface profile is finished.

When a coating is employed that has been prepared by means of the plasma spraying method, the most advantageous combinations in respect of wear resistance and toughness are obtained with a combination of $Cr_2O_3$—$TiO_2$ and with a combination of $Al_2O_3$—$ZrO_2$. In the HVOF method, $Al_2TiO_5$ can also be used.

When a calender roll in accordance with the invention is used for manufacture of paper/board, the roughness of the roll coating is copied onto the paper that is produced. As a result of this, the roughness measured from the paper is lowered, but the gloss is not increased, whereas it is increased when smooth rolls are used. An elevated temperature of from about 60° C. to about 250° C. and a higher nip pressure 5 MPa to about 50 MPa often enhance the operation of the roll, but the method is also well suitable for operating at lower temperatures of from about 10° C. to about 50° C. The desired quality of the paper/board that is produced and the non-calendered roughness of the paper determine the roughness (Ra) of the roll to be used. A preferable range of Ra is from about 0.2 μm to about 2.0 μm. In this way, a roll face is provided that is considerably less dependent on the filler and coating agents of paper, as compared with the earlier methods, so that it is possible to choose the coating and filler agents suitable for printing or equivalent more freely.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A roll for a paper or board machine or a finishing machine, comprising a frame part, and a ceramic layer having a thickness of from about 100 μm to about 2000 μm arranged on said frame part, said ceramic layer including from about 50% to about 95% by weight of $Cr_2O_3$ and from about 3% to about 50% by weight of $TiO_2$ and that the roughness Ra of an outer face of said ceramic layer is from about 0.2 μm to about 2.0 μm.

2. The roll of claim 1, wherein said ceramic layer includes from about 55% to about 80% of $Cr_2O_3$ and from about 20% to about 45% of $TiO_2$.

3. The roll of claim 1, wherein an outer surface of said ceramic layer constitutes an exposed face of the roll.

4. The roll of claim 1, wherein said ceramic layer further includes at least one additional metal oxide selected from a group consisting of oxides of aluminum, silicon, zirconium, magnesium, manganese, tin, tungsten and mixtures thereof.

5. The roll of claim 1, further comprising at least one adhesion/corrosion-protection layer having a thickness of from about 50 μm to about 400 μm interposed between said frame part and said ceramic layer, each of said at least one adhesion/corrosion-protection layer including a metal or a metal alloy.

6. The roll of claim 1, wherein said ceramic layer is formed by a high-velocity flame spraying or by plasma spraying ceramic particles.

7. The roll of claim 1, wherein the roll is a press roll for a paper machine, a variable-crown roll for a paper machine, a center roll for a press in a paper machine, a backup roll for an extended-nip press in a paper machine, a hot press roll in a paper machine, a calender roll for a calender or a thermo roll for a calender.

8. The roll of claim 1, wherein the roll is heatable.

9. The roll of claim 2, wherein the roughness Ra of the outer face of said ceramic layer is from about 0.4 μm to about 1.5 μm.

* * * * *